US007182162B2

(12) United States Patent
Beuershausen et al.

(10) Patent No.: US 7,182,162 B2
(45) Date of Patent: Feb. 27, 2007

(54) SHIRTTAILS FOR REDUCING DAMAGING EFFECTS OF CUTTINGS

(75) Inventors: Christopher C. Beuershausen, Spring, TX (US); Raul E. Lema, The Woodlands, TX (US); Ronald Hales, Cleveland, TX (US); Don Q. Nguyen, Houston, TX (US); Gregory L. Ricks, Spring, TX (US); Chih C. Lin, Spring, TX (US); Terry J. Koltermann, The Woodlands, TX (US); Mark E. Morris, Conroe, TX (US); Chris M. McCarty, Houston, TX (US); Ronald L. Jones, New Waverly, TX (US); James L. Overstreet, Tomball, TX (US); Rudolf Carl Otto Pessier, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 235 days.

(21) Appl. No.: 10/902,222

(22) Filed: Jul. 29, 2004

(65) Prior Publication Data

US 2006/0021800 A1 Feb. 2, 2006

(51) Int. Cl.
*E21B 10/50* (2006.01)

(52) U.S. Cl. ..... 175/374; 175/425

(58) Field of Classification Search ..... 175/374, 175/425

See application file for complete search history.

(56) References Cited

U.S. PATENT DOCUMENTS 3,158,214 A * 11/1964 Wisler et al. ..... 175/375
3,628,616 A 12/1971 Neilson
4,591,008 A 5/1986 Oliver
5,074,367 A 12/1991 Estes
5,145,016 A 9/1992 Estes
5,201,376 A 4/1993 Williams
5,289,889 A 3/1994 Gearhart et al.
5,415,243 A 5/1995 Lyon et al.
5,421,423 A 6/1995 Huffstutler
5,553,681 A 9/1996 Huffstutler et al.
5,709,278 A 1/1998 Crawford
5,722,497 A 3/1998 Gum et al.
5,755,297 A 5/1998 Young et al.
5,755,298 A 5/1998 Langford, Jr. et al.
5,755,301 A 5/1998 Love et al.
5,890,550 A 4/1999 Swadi et al.
6,116,357 A 9/2000 Wagoner et al.
6,173,797 B1 1/2001 Dykstra et al.
6,575,350 B2 6/2003 Evans et al.
6,607,047 B1 * 8/2003 Swadi et al. ..... 175/374
2002/0092684 A1 7/2002 Singh et al.
2005/0252691 A1 * 11/2005 Bramlett et al. ..... 175/374

OTHER PUBLICATIONS

Beuershausen, C., 1 page drawing OD Hardfacing (Mar. 13, 2003), and was sold in May of 2003.

* cited by examiner

*Primary Examiner*—William Neuder
(74) *Attorney, Agent, or Firm*—Bracewell & Giuliani LLP

(57) ABSTRACT

An earth-boring bit has a bit body that includes head sections, each having depending bit legs with a circumferentially extending outer surface, a leading side, and a trailing side. A bearing shaft depends inwardly from each of the bit legs for mounting a cutter. The bit includes a beveled surface formed at a junction of the leading side and the outer surface of each bit leg. The beveled surface is angled relative to a radial plane emenating from the axis of the bit. The angle of the beveled surface is at least 20 degrees, and extends to an inner surface of the bit leg. The bit can also have a layer of hardfacing on the leading, trailing and shirttail surfaces of the bit leg. A diversion finger of hardfacing extends circumferentially to direct cuttings.

26 Claims, 8 Drawing Sheets

SHIRTTAILS FOR REDUCING DAMAGING EFFECTS OF CUTTINGS

BACKGROUND OF THE INVENTION

1. Field of the Invention

This invention relates generally to earth-boring drill bits and particularly to improved head sections for such bits.

2. Background of the Art

In drilling bore holes in earthen formations by the rotary method, rock bits fitted with one, two, or three rolling cutters are employed. The bit is secured to the lower end of a drillstring that is rotated from the surface, or the bit is rotated by downhole motors or turbines. The cutters or cones mounted on the bit roll and slide upon the bottom of the bore hole as the bit is rotated, thereby engaging and disengaging the formation material to be removed. The rolling cutters are provided with cutting elements that are forced to penetrate and gouge the bottom of the borehole by weight of the drillstring. The cuttings from the bottom sidewalls of the borehole are washed away by drilling fluid that is pumped down from the surface through the hollow drillstring.

Before the cuttings are washed away, the cuttings slide over portions of the drill bit while the bit is rotating. The cuttings are abrasive and can cause wear on the surfaces of the drill bit, which can eventually lead to failure. When faced with wear problems, especially in the art of the cutting elements on the cutters, it has been common in the arts since at least the 1930s to provide a layer of wear-resistance metallurgical material called "hardfacing" over those portions of the teeth exposed to the most severe wear. The hardfacing typically consists of extremely hard particles, such as sintered, cast, or macrocrystalline tungsten carbide, dispersed in a metal matrix. Such hardfacing materials are applied by welding a metallic matrix to the surface to be hardfaced.

Moreover, sometimes the cuttings accumulate and get compressed between the cutters and the bit legs that support the cutters or cones. In these situations, the abrasive cuttings can damage the seals that are positioned between the cutters and the bearings that hold the cutters relative to the bit legs of the drill bit. A rounded end of the bit leg that corresponds with the cutter is commonly referred to as a shirttail. Various attempts have been made in differing the geometry of the shirttail in order to reduce the ability of cuttings to accumulate between the cutter and the bit leg. For example, designers have extended the shirttail to slightly overhang the gap between the cutter and the bit leg. However, as the lifespan of the cutters continues to grow, cuttings continue to accumulate, becoming lodged with time, and eventually damaging and causing failure of the bearing seals.

BRIEF SUMMARY OF THE INVENTION

An earth-boring bit has a bit body and a cantilevered bearing shaft depending therefrom. The bit body includes a plurality of head sections or bit thirds welded together. Each head section includes a depending bit leg with a circumferentially extending outer surface, a leading side, and a trailing side on the other side of the bit leg. The cantilevered bearing shaft has an axis and depends inwardly from each of the bit legs for mounting a cutter. The earth-boring bit also includes a machined beveled surface formed at a junction of the leading side and the outer surface of the bit leg of each head section. The machined beveled surface is angled relative to a line perpendicular or radial to an axis of the cantilevered bearing shaft. The angle of the machined beveled surface is at least 20 degrees. The earth-boring bit can also have a layer of hardfacing on the leading, trailing and shirttail surfaces of the bit leg for helping to reduce wear on the head section.

The earth-boring bit can also have a bead of a hardfacing composition of carbide particles dispersed in a metallic matrix formed on a surface of the head section. The hardfacing bead is for diverting cuttings. The bead of hardfacing has a leading surface and a trailing surface. The bead extends from the leading surface to the trailing surface, thereby defining a diversion surface that engages and guides the cuttings when the earth-boring bit is rotating. Such a diversion surface can help guide cuttings around structures on the head section, or act as a barrier to cutting accumulating on structures.

DETAILED DESCRIPTION OF THE PREFERRED EMBODIMENT

Figure 1:
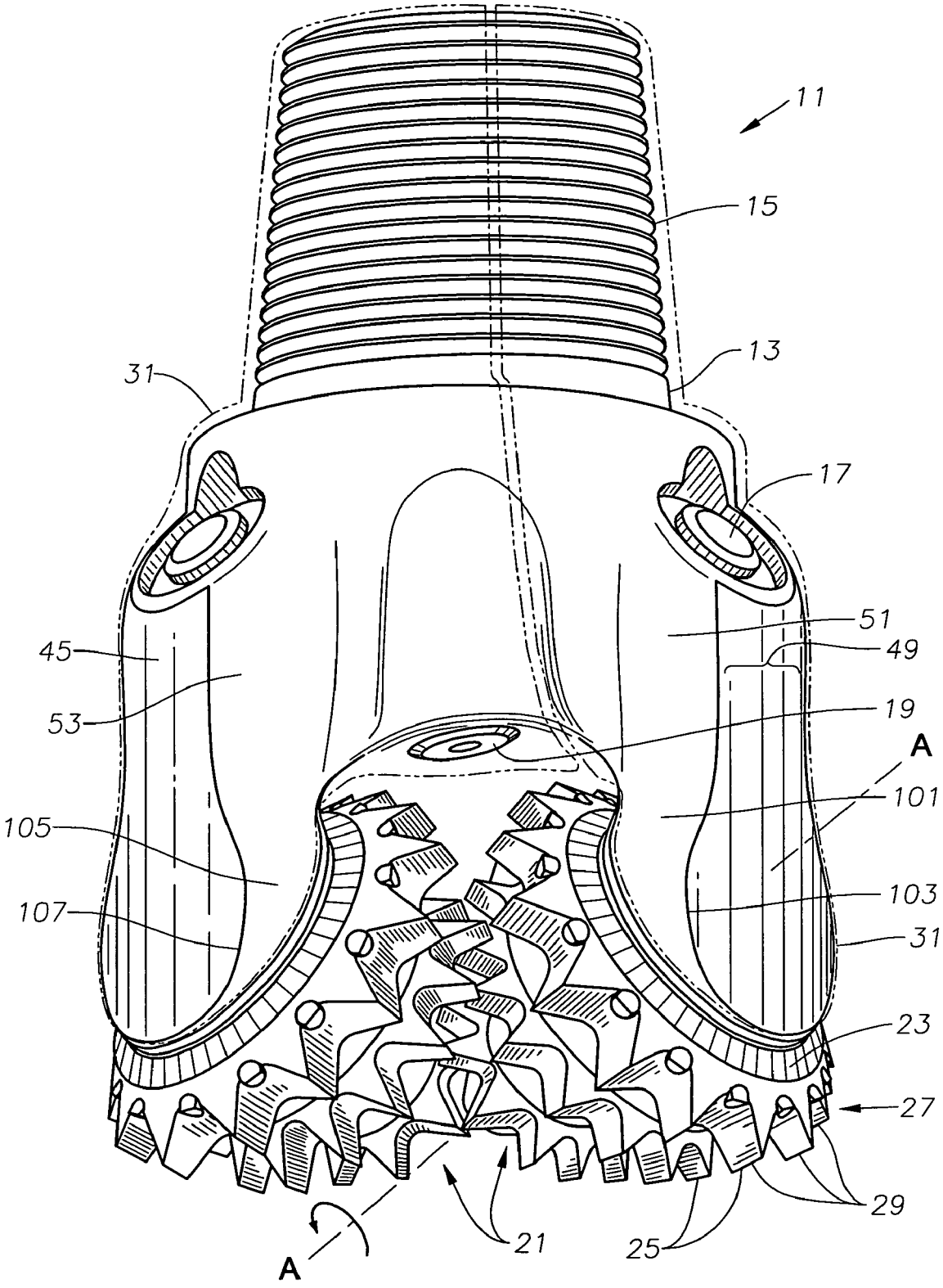
FIG. 1 is a perspective view of an earth-boring bit constructed in accordance with this invention.

Referring to FIG. 1, an earth-boring bit 11 according to the present invention is illustrated. Bit 11 includes a bit body 13 having threads 15 at its upper extent for connecting bit 11 into a drill string (not shown). Each leg of bit 11 is provided with a lubricant compensator 17. At least one nozzle 19 is provided in bit body 13 for directing pressurized drilling fluid from within the drill string to cool and lubricate bit 11 during drilling operation. A plurality of cones or cutters 21 are rotatably secured to respective legs of bit body. Typically, each bit 11 has three cutters 21, and one of the three cutters is obscured from view in FIG. 1. Each cutter 21 has a shell surface including a gage surface 23 and a heel region indicated generally at 27. Teeth 25 are formed in heel region 27 and form a heel row 29 of teeth 25.

Typically each earth-boring bit 11 includes three bit thirds, or head sections 31 as represented by dotted lines on FIG. 1, that are welded together during assembly. Two of the bit thirds or head sections 31 are visible from the perspective shown in FIG. 1, and for the purpose of convenience while describing each bit third or head section 31, a single head section 31 is shown in FIGS. 2–13.

Figure 2:
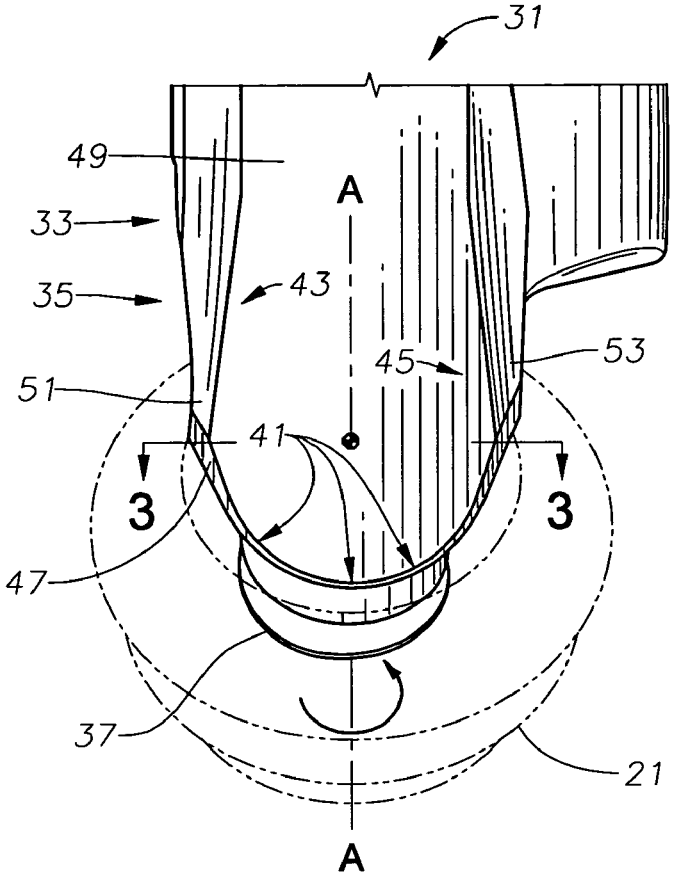
Fig. 2 (Prior Art)
FIG. 2 is a perspective view of a prior art head section of an earth-drilling bit similar to that shown in FIG. 1.

As shown in prior art FIG. 2, each head section 31 includes a head section body 33 and a bit leg 35. Head section body 33 is typically nearest threads 15 used for connection to drilling pipe. During operation, bit leg 35 typically extends axially downward from head section body 33 in order to support one of the cutter 21 during drilling operations. A bearing pin 37 is cantilevered from an interior surface of bit leg 35 axially downward and radially inward from bit leg 35 in order to support each cutter 21. Bearing pin 37 is shown in prior art FIG. 2 within cutter 21 that is represented by dotted lines, and bearing pin 37 is not visible in FIG. 1 because cutters 21 are attached thereto and thereby covering bearing pin 37 in the perspective view. As shown in FIG. 1, bit leg 35 is rounded so as not to extend beyond cutters 21. As shown in prior art FIG. 2, when viewed from the outer side, bit leg 35 appears to be U-shaped at the juncture with cutter 21. The U-shaped edge of bit leg 35 defines a shirttail 41 of each bit leg 35 associated with each head section 31.

Each bit leg 35 preferably includes a leading side 43 and a trailing side 45. Leading side 43 is generally the edge that encounters the hole being drilled first due to the direction of rotation of each boring bit 11. Each bit leg 35 also includes a finished surface 47 located along each shirttail 41. Typically head section 31, including bit leg 35, is a forged piece of metal that can have imperfections and rough edges, including the edge forming shirttail 41. Finished surface 47 is created after touching up shirttail 41 with grinding, filing, or machining, thereby removing any imperfections.

Each head section 31 preferably includes an outer surface 49 that defines part of an outer circumference surrounding earth-boring bit 11 when all three head sections 31 are combined to form earth-boring bit 11. Typically outer surface 49 is machined to a relatively smooth finish so that outer surface 49 does not extend radially beyond the bore of the hole being drilled by cutters 21. The portions of head sections 31 that are radially inward of outer surface 49 typically are not machined, but are rather left in their manufactured or forged state. As shown in FIG. 1 and prior art FIG. 2, each head section 31 typically includes a pair of flanks extending radially outward toward outer surface 49. Each head section 31 typically includes a leading flank 51 and a trailing flank 53. Leading flank 51 joins leading side 43 and trailing flank 53 joins trailing side 45. Leading and trailing flanks 51 and 53 are primarily located on head section body 33 with a portion extending down bit leg 35 and connecting with finished surface 47.

Figure 3:
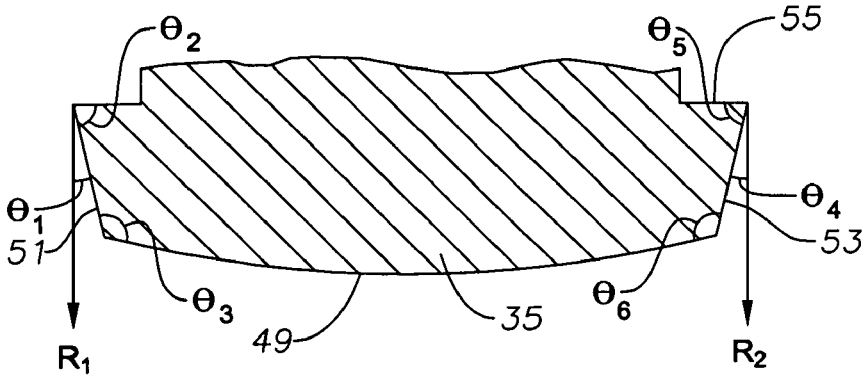
Fig. 3 (Prior Art)
FIG. 3 is a cross sectional view, taken along the line 3—3 of the prior art head section shown in FIG. 2.

Referring to FIGS. 2 and 3, each bit leg 35 preferably includes an inner surface 55 that is located opposite outer surface 49. Inner surface 55 preferably includes a last machined surface that is typically machined flat so as to cooperate with cutters 21 that are connected to bearing pin 37 for each head section 31. Inner surface 55 also includes a portion axially upward from the last machined surface that is curved in a convex manner in a transverse direction and also curves upward in where it joins the inner surface of the other bit legs 35 to form a dome above cutters 21. As discussed above, outer surface 49 is machined so that head section 31 does not extend radially beyond the bore drilled by cutters 21. Therefore, outer surface 49 typically does not extend perfectly parallel with inner surface 55, but rather is arcuate with respect to inner surface 55. Finished surface 47 is angled relative to a radial line extending from inner surface 55 that is coincident with the axis of rotation of the bit and extends radially outward. The radial line $R_1$ generally represents lines along a radius of bit leg 35, and is shown by indicator line $R_1$. Radial line $R_1$ is offset from and extends substantially parallel to the axis of rotation of cutter 21 and the centerline of bearing pin 37. Preferably, radial line $R_1$ extends substantially perpendicular from inner surface 55 and the angle between radial $R_1$ and finished surface 47 is shown by angle $\theta_1$. Typically angle $\theta_1$ is between 0 and 10°. Angle $\theta_2$ represents the corresponding angle that comprises the remainder of the degrees between radial line $R_1$ and an inner surface 55. Because angle $\theta_1$ is typically between 0 and 10°, angle $\theta_2$, or the angle between inner surface 55 and the leading portion of finished surface 47, or leading flank 51, is typically between 80 and 90°. Similarly, the angle between outer surface 49 and leading flank 51, or the leading portion of finished surface 47, is represented by angle $\theta_3$ and is typically between about 90° and about 100°. Angle $\theta_3$ can, but does not always, correspond directly to angle $\theta_2$ due to the arcuate shape of outer surface 49.

For the trailing portion relative to finished surface 47, trailing flank 53 is angled relative to a radial line $R_2$ extending from inner surface 55. As best shown on FIG. 3, trailing flank 53 extends at an angle $\theta_4$ from radial line $R_2$ and from inner surface 55. Angle $\theta_4$ is also typically between 0 and 10°. It is important to note that angles $\theta_1$ and $\theta_4$ are typically only between 0 and 10°. The angle from inner surface 55 to trailing flank 53 is shown by angle $\theta_5$, which is the corresponding angle with angle $\theta_4$. Because radial line $R_2$ from inner surface 55 extends at a right angle with inner surface 55 and $\theta_4$ is between 0 and 10°, angle $\theta_5$ is typically between 80 and 90°. The angle between outer surface 49 and trailing flank 53 is represented by angle $\theta_6$. Typically angle $\theta_6$ will be about 90° to about 100°. Due to the possible arcuate shape of outer surface 49, angle $\theta_6$ can vary slightly from what a corresponding angle would be if outer surface 49 were exactly parallel with inner surface 55.

Figure 4:
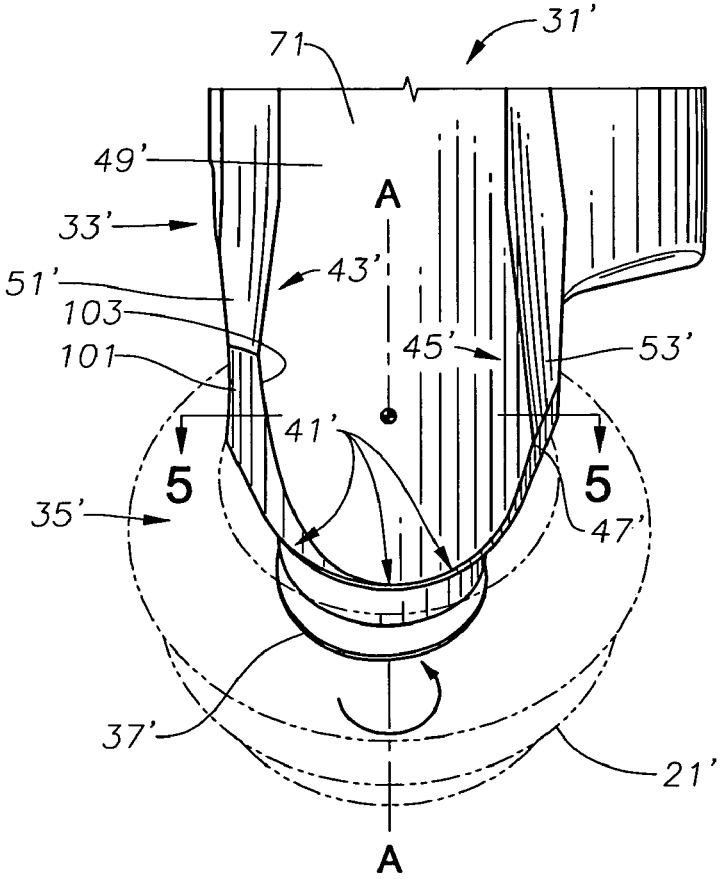
FIG. 4 is a perspective view of a head section of the earth-drilling bit shown in FIG. 1 and constructed in accordance with an embodiment of this invention.

Referring to FIG. 4, an embodiment of a portion of applicant's invention is shown. Head section 31' preferably includes a head section body 33' and a bit leg 35' having a bearing pin 37' extending radially inward and axially downward therefrom, for supporting a cutter 21'. Bit leg 35' preferably includes a shirttail 41' extending along an axially downward portion of bit leg 35' similar to the prior art as described for FIG. 2. Head section 31' preferably includes a leading side 43' and a trailing side 45' that substantially correspond to the leading and trailing sides 43, 45 discussed above for the prior art. In the embodiment shown on FIG. 4, a finished surface 47' extends along a portion of shirttail 41' preferably from a lower portion of the shirttail 41' along trailing side 45'. On head section 31', finished surface 47' is machined to provide consistent coverage of the cone backface, or the surface of the cone adjacent inner surface 55.

Head section 31' preferably includes an outer surface 49' that is rounded off in a substantially similar fashion as outer surface 49 in the prior art FIG. 2. Outer surface 49' should not extend radially outward beyond the outermost portions of cutter 21'. Head section 31' preferably also includes a leading flank 51', a trailing flank 53' and an inner surface 55' that are in substantially the same locations as leading and trailing flanks and inner surfaces 51, 53, and 55 in prior art FIGS. 2 and 3. Leading flank 51' includes to a machined beveled leading surface 101. In the embodiment shown in FIG. 4, machined beveled leading surface 101 is preferably created by machining beyond typical finishing and touch-up procedures associated with finishing surface 47'. Machined beveled leading surface 101 intersects with outer surface 49' at juncture 103.

Figure 5:
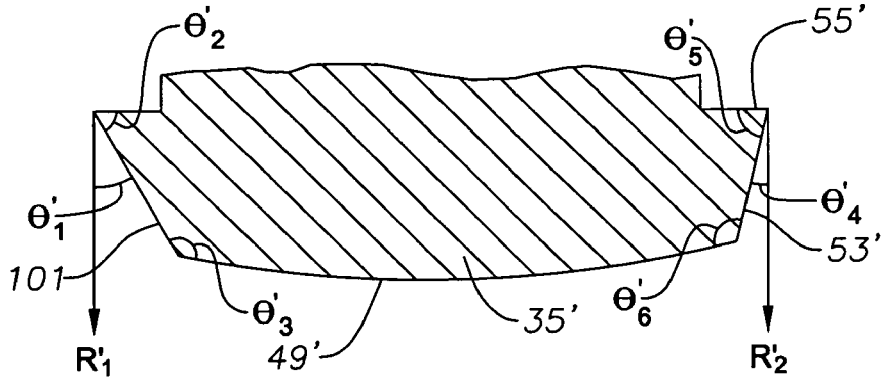
FIG. 5 is a cross sectional view, taken along the line 5—5 of the head section shown in FIG. 4.

The differences between machined beveled leading surface 101 from finished surface 47 of prior art FIGS. 2 and 3, is best shown in FIG. 5. Radial line $R_1'$ is shown extending substantially parallel to the centerline of bearing pin 37' and substantially perpendicular from inner surface 55' of bit leg 35'. The angle between leading flank 101 and radial $R_1'$ is represented by angle $\theta_1'$, while the angle between leading flank 101 and inner surface 55' is represented by angle $\theta_2'$. Leading flank 51' comprises machined beveled leading surface 101, therefore angle $\theta_1'$ is much larger than 10°. Along the cross-section that intersects the centerline of bearing pin shown in FIG. 5, angle $\theta_1'$ is typically between 20°–60°, but can have various ranges including 20°–50° and as shown in FIG. 5 being about 30°. Along cross sections both closer to and farther away from the tip of shirttail 41', angle $\theta_1'$ can also vary due to machining techniques. Because angle $\theta_2'$ is a corresponding adjacent angle to angle $\theta_1'$, angle $\theta_2'$ can have a range of 30 °–70°, and can sometimes be between 40 °–70° or as shown in FIG. 5 about 60°. The angle between outer surface 49' and leading flank 51' at machined beveled leading surface 101 is represented by angle $\theta_3'$, which is an obtuse angle that is directly proportional to $\theta_2'$. Angle $\theta_3'$ can range between 110 °–150°, 120°–140° or as shown in FIG. 5 at around 120°. Similar to angle $\theta_3$ and prior art FIGS. 2 and 3, angle $\theta_3'$ can also vary slightly due to the arcuate shape of outer surface 49' relative to inner surface 55'.

As shown in FIG. 5, angle $\theta_3'$ is substantially measured about juncture 103 between machined beveled leading surface 101 and outer surface 49'. Machined beveled leading surface 101 provides an angle along flank 51' (FIG. 4) that is advantageously more conducive to allowing flow of cuttings around bit leg 35' during rotation of earth-boring bit 11'. Having such a leading flank as machined beveled leading surface 101 advantageously reduces the accumulation of drilling cuttings that can accumulate on leading flank 51' when merely a finished surface 47' is used.

Figure 7:
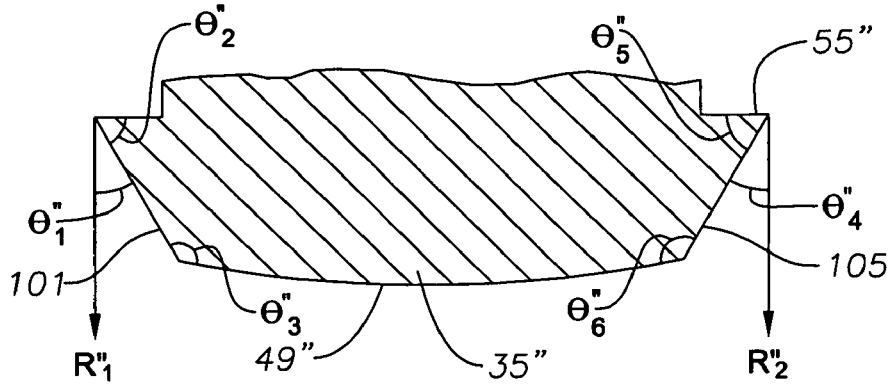
FIG. 7 is a cross sectional view, taken along the line 7—7 of the head section shown in FIG. 6.
Figure 6:
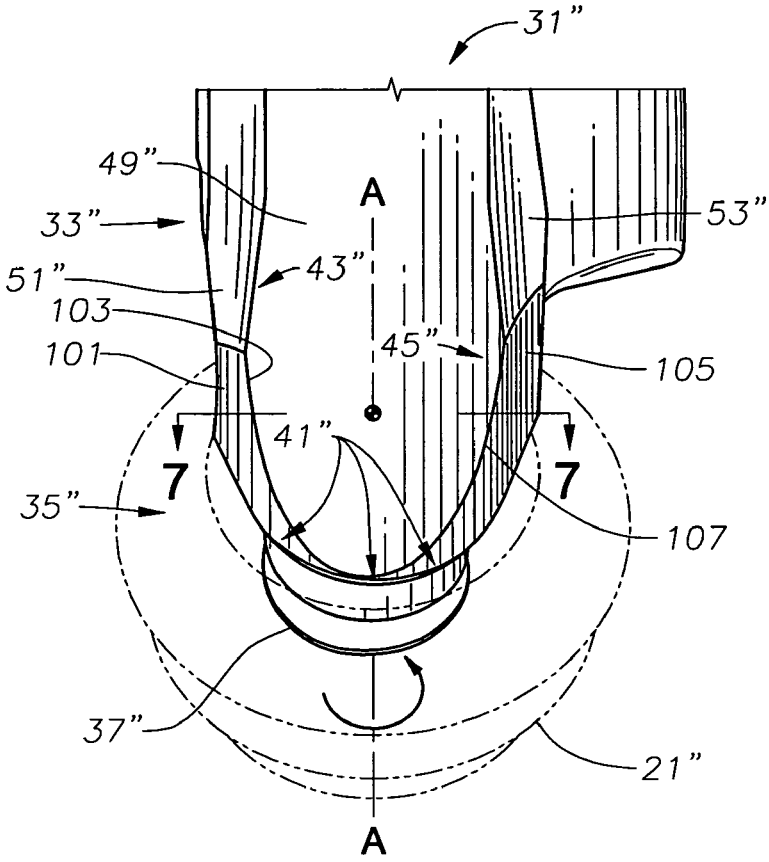
FIG. 6 is a perspective view of a head section of the earth-drilling bit shown in FIG. 1 and constructed in accordance with another embodiment of this invention.

Referring to FIGS. 6 and 7, another embodiment of a head section 31" for earth-boring bit 11 as shown. Head section 31", like head sections 31 and 31', also comprise a head section body 33", bit leg 35" and a bearing pin 37" for supporting a cutter 21". A shirttail 41" is also located along the lowermost edges of bit leg 35" similar to shirttail 41 and 41' in the embodiments discussed above. Bit leg 35" preferably includes in this embodiment an outermost surface 49" that is machined to a desired finish so as not to extend radially beyond the radial outer most portion of cutters 21". Bit leg 35" preferably also includes leading and trailing flanks 51", and 53", as well as an inner surface 55" which substantially correspond to the leading, trailing, and inner surfaces 51, 53, 55 for the embodiments discussed above.

In the embodiment shown in FIGS. 6 and 7, leading flank 51" (FIG. 6) preferably includes machined beveled leading surface 101 that intersects outer surface 49" like the embodiment shown in FIGS. 4 and 5. Machined beveled leading surface 101 preferably is angled as described above. In the embodiment shown in FIGS. 6 and 7, trailing flank 53" (FIG. 6) preferably also comprises a machined beveled trailing surface 105 located along trailing side 45". Machined beveled trailing surface 105 preferably extends from a lowermost portion of shirttail 41" toward an upper portion of trailing flank 53". Machined beveled trailing surface 105 intersects outer surface 49" at a juncture 107 defining an outer edge of machined beveled trailing surface 105.

As best shown in FIG. 7, machined beveled trailing surface 105 of trailing side 45" is angled inward from inner surface 55" along shirttail 41" toward outer surface 49". Machined beveled trailing surface 105 is angled inward from radial line $R_2''$ extending from inner surface 55". The angle from radial line $R_2''$ to machined beveled surface 105 is angle $\theta_4''$. Like angle $\theta_1'$ in FIGS. 4 and 5, $\theta_4''$ is between 20°–60°, but can have various ranges including 20°–50°, and as shown in FIG. 7 being about 30°. An angle $\theta_5''$ compliments angle $\theta_4''$ and defines the angular measurement from machined beveled surface 105 to inner surface 55". Angle $\theta_5''$ is between 30°–70°, and can sometimes be between 40–70°, or as shown in FIG. 7 about 60°, depending on the angle of $\theta_4''$. Angle $\theta_6''$ defines the obtuse angle between outer surface 49" and machined beveled trailing surface 105. Because of the arcuate shape of outer surface 49", angle $\theta_6''$ is between about 110°–150°, 120°–140°, or as shown in FIG. 7 at around 120°.

The embodiment shown in FIGS. 6 and 7 provides machined beveled surfaces 101 and 105, which help prevent the accumulation of cuttings during operations by creating a less aggressive outer surface, i.e. one that is tapered or beveled from leading side 43" to outer surface 49" and from outer surface 49" to trailing flank 53". Lessening the accumulation of cuttings can help reduce the wear on the outer portions of earth-boring bit 11, as well as help prevent cuttings from being compressed between shirttail 41" and cutter 21" by directing cuttings more easily from leading side 43".

Figure 8:
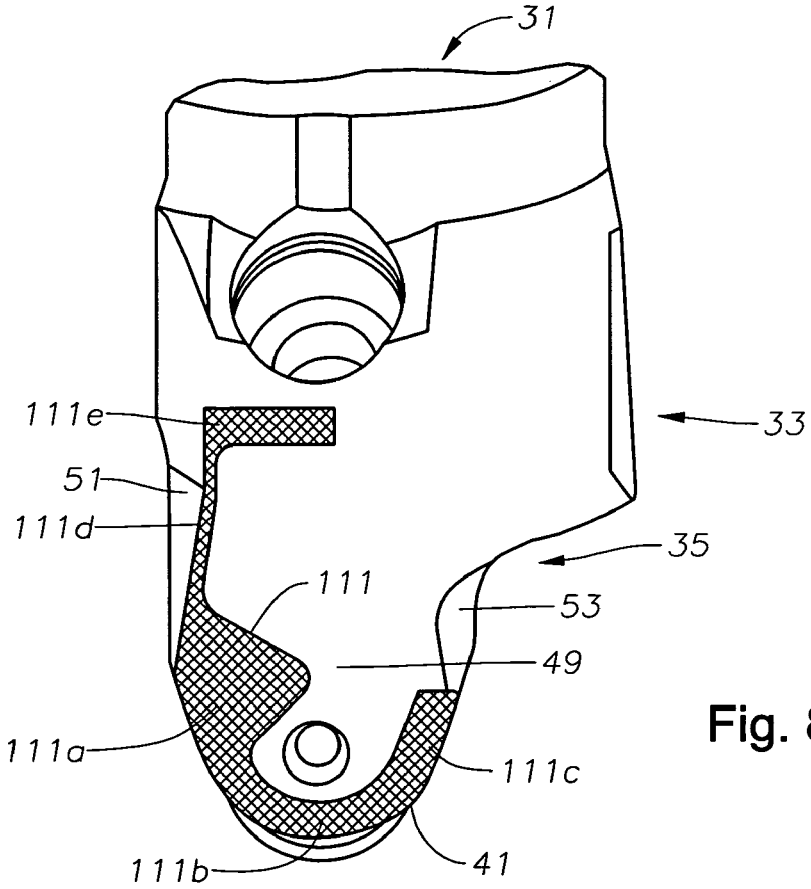
FIG. 8 is a side perspective view of a head section of the earth-drilling bit shown in FIG. 1 and constructed in accordance with another embodiment of this invention.

Referring to FIG. 8, head section 31 includes a hardfacing 111 applied to an outer portion of head section 31. Hardfacing 111 can be applied to any of the embodiments described above, accordingly for simplicity numbers will not differentiate between prime and double prime notation unless necessary. In the embodiment shown in FIG. 8, hardfacing 111 is located on some of the radially outer surfaces of the head section 31 to form a pattern or layer of hardfacing 111. Hardfacing 11 includes a leading portion **111*a* that begins at leading side 43 along shirttail 41. Leading hardfacing 111*a* extends circumferentially from leading side 43, over a portion of outer surface 49, toward trailing side 45. Leading hardfacing 111*a* also extends generally axially upward from shirttail 41. Hardfacing 111 in the embodiment shown in FIG. 8 includes a tip portion hardfacing 111*b* located along shirttail 41 between leading side 43 and trailing side 45. Hardfacing 111 also includes a trailing hardfacing 111*c* located on trailing side 45 along shirttail 41. Preferably leading, tip portion, and trailing hardfacings 111*a*, 111*b*, and 111*c* are connected to form a layer of hardfacing around bit leg 35 along shirttail 41, which can be achieved by known procedures in the art like overlapping welding beads from one section to the next. When machined beveled surfaces 101 and/or 105 are present, hardfacing 111 helps to reduce the wear due to the cuttings passing over shirttail 41, leading side 43, and trailing side 45. Preferably, hardfacing 111 follows the contours created by beveling the surfaces so that the angles with hardfacing remain substantially the same as without hardfacing 111**.

In the embodiment shown in FIG. 8, hardfacing 111 preferably also includes an upper leading surface hardfacing **111*d* extending upward along leading side 43. Upper leading surface hardfacing 111*d* is preferably extending along leading side 43 just below outer surface 49. Hardfacing along this region helps to reduce wear along leading side 43 at a transition with outer surface 49. This transition can be part of juncture 103 created by beveling, or it can be the natural juncture created upon forging of head section 31. Hardfacing 111 also includes an upper transverse finger 111***e* extending circumferentially from an upper end of upper leading surface hardfacing 111*d*. Finger 111*e* extends generally horizontally about ⅓–½ the distance to trailing side 45 of head section 31. Upper transverse finger 111*e* helps to reduce wear on a portion of head section 31 below lubricant compensator 17, as well as acting as a barrier to prevent cuttings from accumulating in lubricant compensator 17 by diverting cuttings from bit leg 35 to trailing portions of head section 31.

Figure 9:
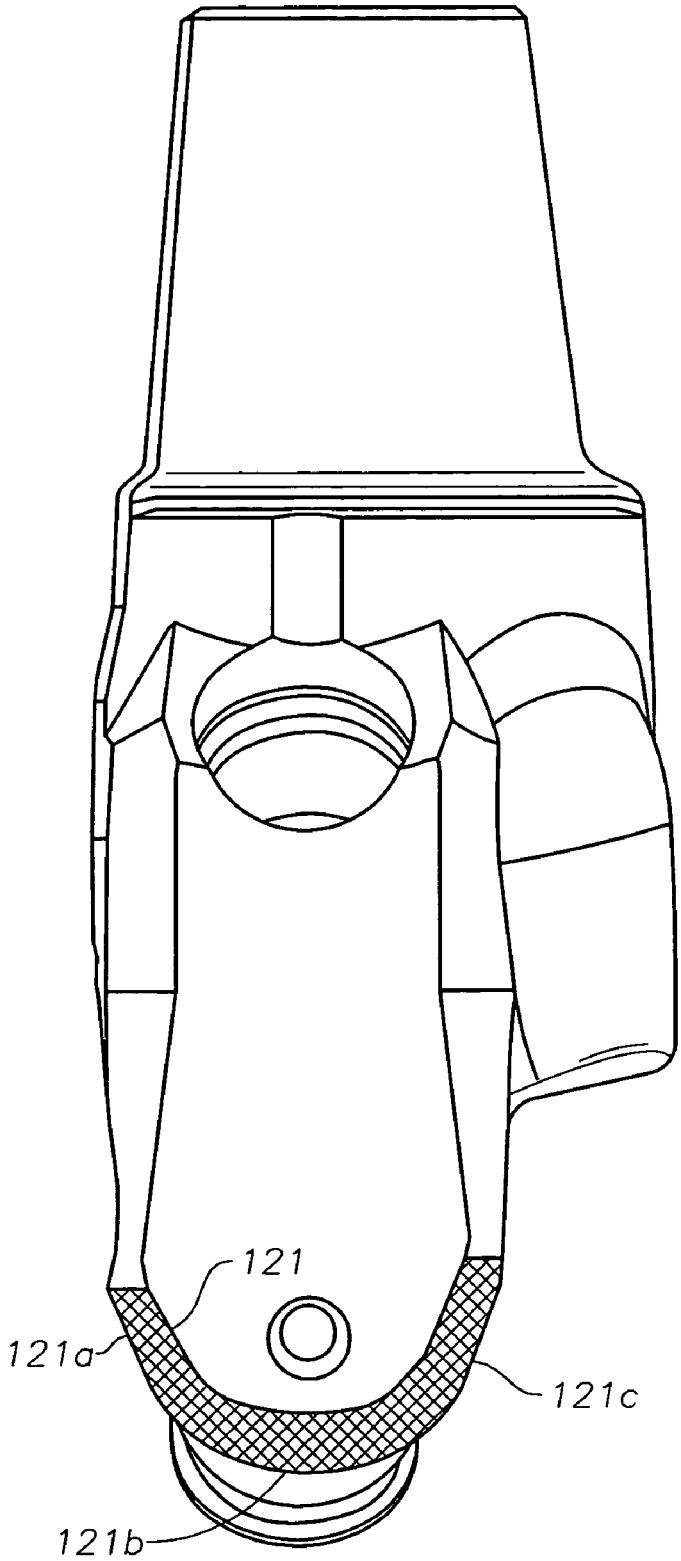
FIG. 9 is a side perspective view of a head section of the earth-drilling bit shown in FIG. 1 and constructed in accordance with another embodiment of this invention.

In the embodiment shown in FIG. 9, a head section 31 includes a layer of hardfacing 121 formed essentially along shirttail 41. Hardfacing 121 comprises leading, tip, and trailing hardfacings 121*a*, 121*b*, and 121*c* located in similar positions as in the embodiment discussed in FIG. 8. Leading hardfacing 121*a* however, does not extending circumferentially around outer surface 49. Instead, leading hardfacing merely follows shirttail 41 along the leading side 43.

Figure 10:
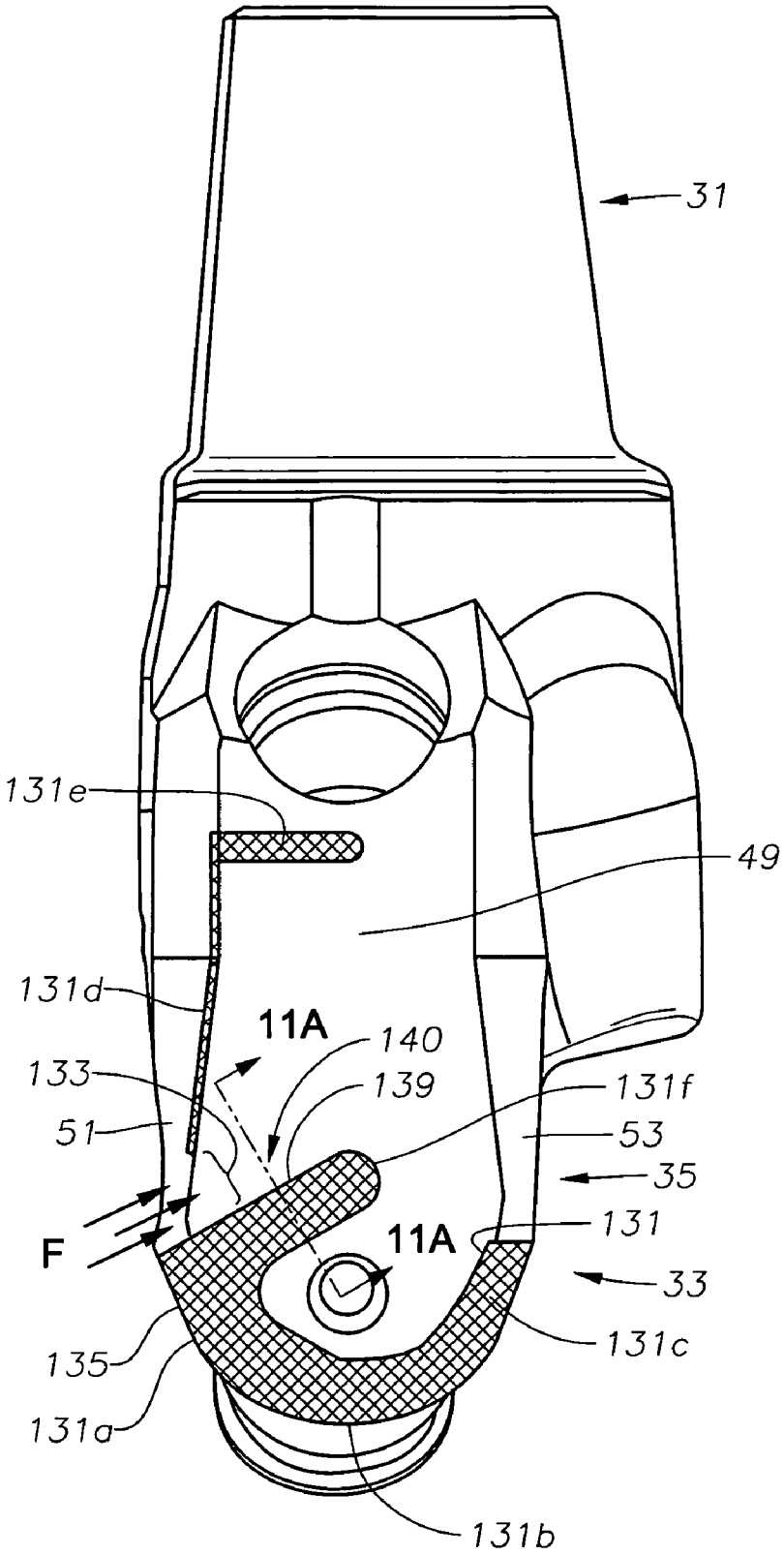
FIG. 10 is a side perspective view of a head section of the earth-drilling bit shown in FIG. 1 and constructed in accordance with another embodiment of this invention.

In the embodiment shown in FIG. 10, a head section 31 includes a layer of hardfacing 131 similar to hardfacing 111 of FIG. 8. Hardfacing 131 includes leading, tip, and trailing hardfacings 131*a*, 131*b*, and 131*c*, as well as upper leading surface hardfacing 111*d* and upper transverse finger 111*e*. However, the embodiment of hardfacing 131 shown in FIG. 10 includes a gap 133 formed between leading hardfacing 131*a* and upper leading surface hardfacing 131*d*. Gap 133 allows for easy flow of cuttings between leading hardfacing 131*a* and upper leading surface hardfacing 131*d*. A transverse finger 131*f* that extends rearwardly and upwardly from leading side 43 about half the distance to trailing side 45. The width of transverse finger 135 is about the same as other portions 131*a*, 131*b*, and 131*c*. The bead of hardfacing in finger 131*f* preferably defines a straight diverting side 139. Cuttings passing through gap 133 slide along diverting side 139 axially upward from the shirttail 41. Diverting side 139 defines a flow through passage 140 on the side of hardfacing 131 through which cuttings travel. In the embodiment shown in FIG. 10, gap 133 is the opening leading to flow through passage 140, and the lower end of upper leading surface hardfacing 131*d* defines an upper portion of flow through passage 140. However, flow through passage 140 can also easily exist when there is no gap formed between leading hardfacing 131*a* and upper leading surface hardfacing 131*d*, but rather merely an absence adjacent diverting side 139 of hardfacing that is the same thickness as the hardfacing of diverting side 139.

Figure 11A:
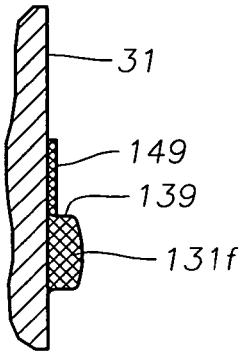
FIG. 11A is a cross sectional view, taken along line 11A—11A of the head section of the earth-drilling bit shown in FIG. 10.
Figure 11B:
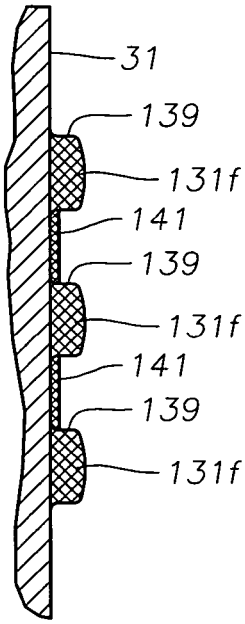
FIG. 11B is a cross sectional view, taken along line 11B—11B of the head section of the earth-drilling bit shown in FIG. 12.

Referring to FIGS. 11A and 11B for example, gap 133 can comprise a layer of wear-resistant material 141 on head section 31 adjacent diverting side 139 of hardfacing. Wear-resistant material 141 is thinner than diverting side 139 of hardfacing, so diverting side helps to ventilate or divert cuttings from the tip of shirttail 41 as the cutting travel from leading side 43 to the trailing side 45. Wear-resistant material 141 can be hardfacing that is applied more thinly than hardfacing forming diverting side 139, or any other wear resistant material known in the art that can be applied to the outer surface of head section 31.

Figure 12:
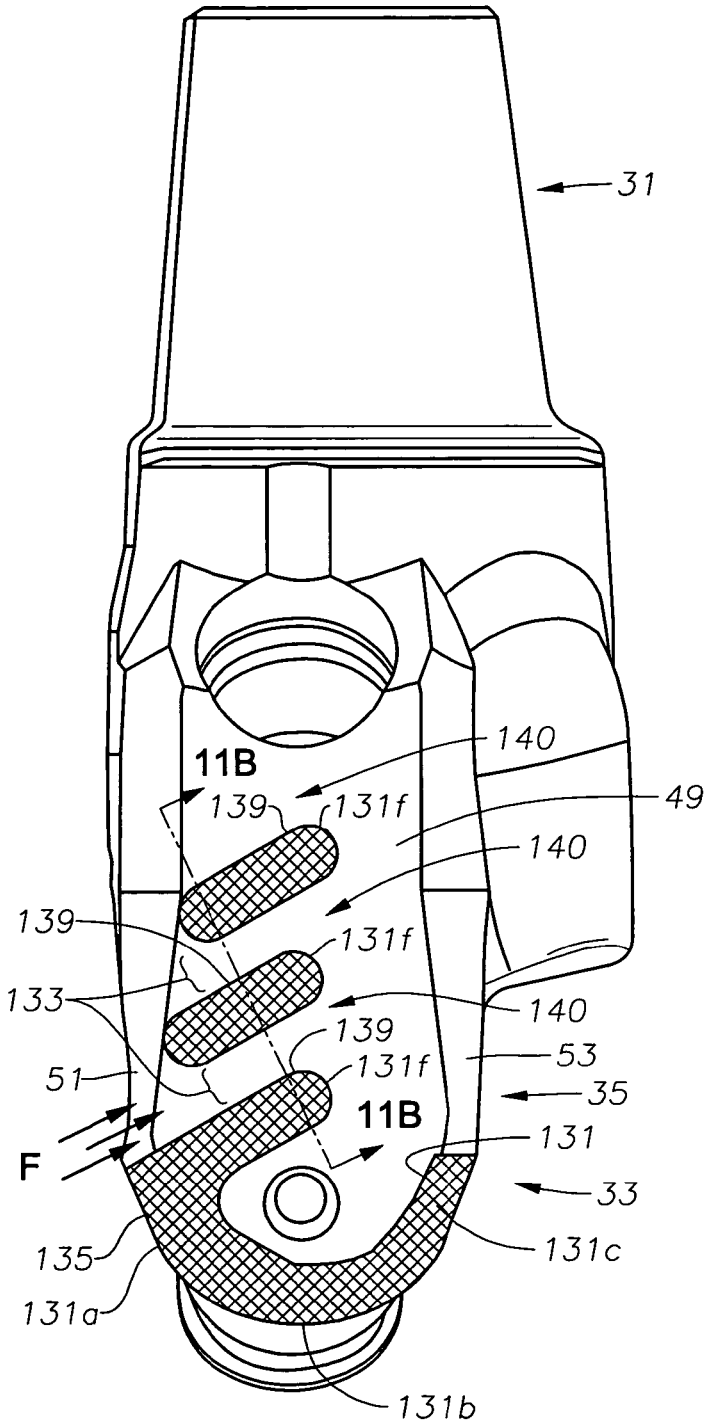
FIG. 12 is a side perspective view of a head section of the earth-drilling bit shown in FIG. 1 and constructed in accordance with another embodiment of this invention.

As shown in FIG. 12, hardfacing 131 can include a plurality of transverse fingers 131*f* positioned on the outer surface of head section 31. The plurality of transverse fingers 131*f* each have diverting sides 139 for diverting cuttings through gaps 133.

The hardfacing embodiments described above are exemplary of various hardfacing patterns that can be used on earth-boring bit 11. These specific hardfacing patterns are considered the best patterns for earth-boring bits 11 at this time. Variations can easily be made to the hardfacing patterns discussed above to protect various surfaces from wear or to divert cuttings from bit leg 35 so that the cuttings do not accumulate beneath shirttail 41 between the cutter 21 and damage bearing seals.

Figure 13:
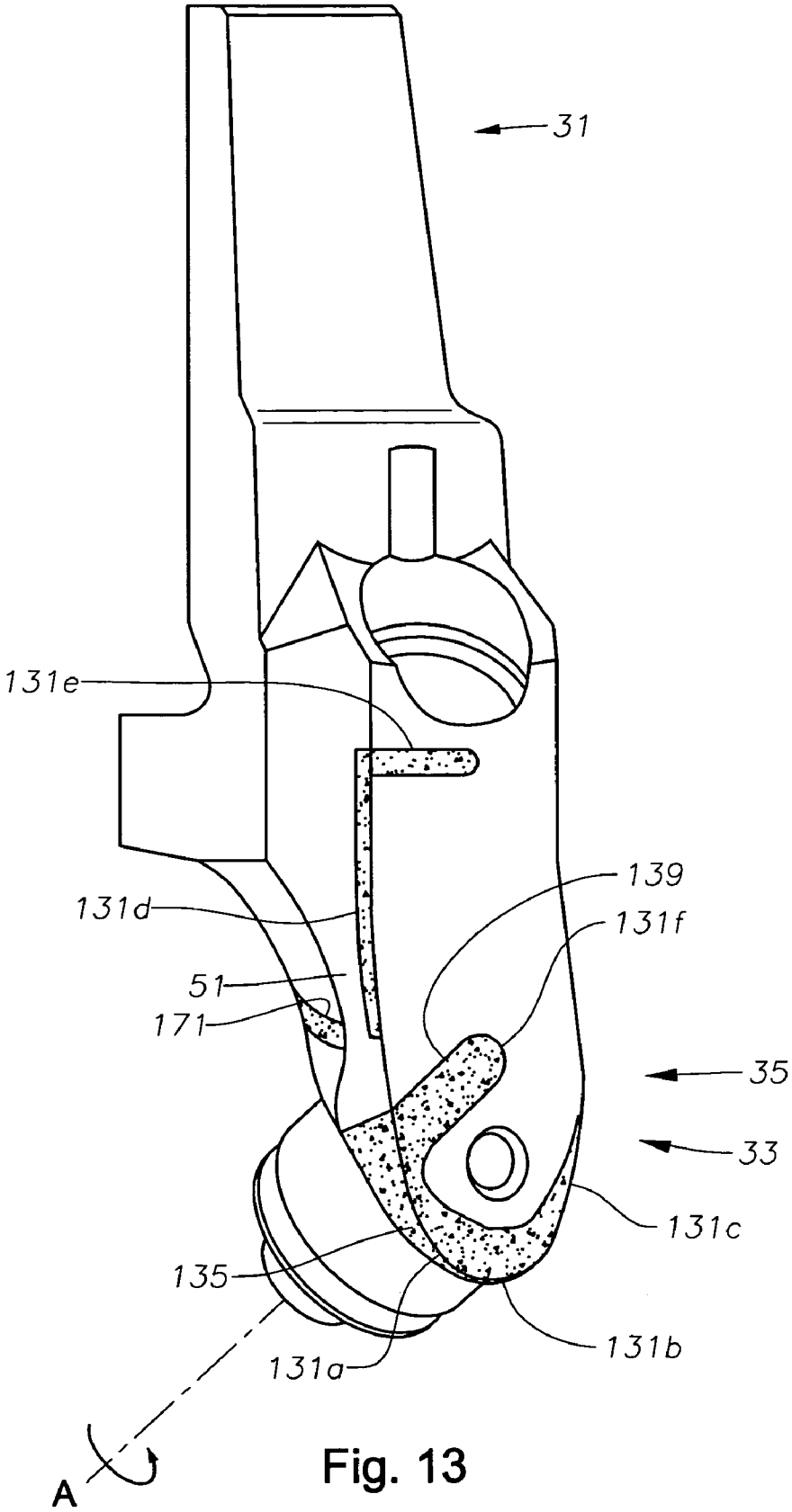
FIG. 13 is a side perspective view of a head section of the earth-drilling bit shown in FIG. 1 and constructed in accordance with another embodiment of this invention.

In the embodiment shown in FIG. 13, a bead of hardfacing 171 is shown on head section 31 extending toward an inner portion of head section 31. Hardfacing 171 comprises a leading edge and a trailing edge with a diverting side extending therebetween. Diverting hardfacing 171 can help to divert cuttings into the crotch of earth-boring bit 11 and reduce the amount of cuttings that may accumulate between the underside of bit leg 35 and cutter 21.

While the invention has been shown in some of its forms, it should be apparent to those skilled in the art that it is not so limited, but is susceptible to various changes without departing from the scope of the invention. Moreover, diverting hardfacings could be created where the flow through channel includes hardfacing that covers the surface of the head section, but is not as thick as the diverting side.

We claim:

1. An earth-boring bit comprising:

a bit body comprising a plurality of head sections, each head section having a depending bit leg with a circumferentially extending outer surface, an inner surface, a leading side and a trailing side;

a cutter rotatably mounted on a cantilevered bearing shaft depending inwardly from each of the bit legs; and a leading side machined beveled surface formed at a junction of the leading side and the outer surface of the bit leg of each head section, the leading side machined beveled surface being an angle relative to a radial plane emanating from an axis of rotation of the bit, the angle being at least 20 degrees.

2. The earth-boring bit of claim 1, wherein the angle is between 20 and 60 degrees.

3. The earth-boring bit of claim 1, wherein the angle is between 20 and 50 degrees.

4. The earth-boring bit of claim 1, wherein the angle is at least 30 degrees and no more than 45 degrees.

5. The earth-boring bit of claim 1, further comprising a trailing side machined beveled surface formed at a juncture of the trailing side and the outer surface of the bit leg, the trailing side machined beveled surface being an angle relative to a radial plane emanating from an axis of rotation of the bit, the angle being at least 20 degrees.

6. The earth-boring bit of claim 1, further comprising a layer of a hardfacing composition of carbide particles dispersed in a metallic matrix formed on the leading side machined beveled surface.

7. The earth-boring bit of claim 1, further comprising a leading edge layer of hardfacing on the leading machined beveled surface; and a transverse finger of hardfacing extending circumferentially from the leading edge layer on the outer surface of the bit leg.

8. The earth-boring bit of claim 1, further comprising:

a lower leading edge layer of hardfacing on the leading side machined beveled surface;

an upper leading edge layer of hardfacing on a leading surface of each head section; and a gap between the upper and lower leading edge layers.

9. The earth-boring bit of claim 1, further comprising:

a lower leading edge layer of hardfacing on the leading side machined beveled surface, the lower leading edge layer having a transverse finger;

an upper leading edge layer of hardfacing on a leading surface of each head section; and a gap between the upper and lower leading edge layers, wherein the gap extends circumferentially along the transverse finger of the lower leading edge layer of hardfacing.

10. The earth-boring bit of claim 1, further comprising:

a lower leading edge layer of hardfacing on the leading side machined beveled surface, the lower leading edge layer having a lower transverse finger;

an upper leading edge layer of hardfacing on a leading surface of each head section, the upper leading edge layer having an upper transverse finger; and a gap between the upper and lower leading edge layers, wherein the gap extends circumferentially along the transverse finger of the lower leading edge layer of hardfacing.

11. An earth-boring bit comprising:

a bit body comprising a plurality of head sections, each head section further comprises a depending bit leg having an outer surface, a leading edge, and trailing edge, the bit leg comprising a machined beveled surface formed at a junction of a leading side and an outer surface of the bit leg of each head section;

a cutter rotatably mounted to cantilevered bearing shaft depending inwardly from each of the head sections for mounting a cutter, the machined beveled surface is angled relative to a line parallel to an axis of the cantilevered bearing shaft, the angle being at least 20 degrees;

a leading edge layer of hardfacing formed on a leading side of each of the head sections, the leading edge layer of hardfacing is on a portion of the machined beveled surface of the bit leg of the head sectional; and a finger of a hardfacing formed on an outer surface of the head section spaced above a lower end of the head section, the finger of hardfacing extending from the leading edge layer of hardfacing toward a trailing side of each head section and having an upper edge that defines a diversion surface that engages and guides the cuttings when the earth-boring bit is rotating.

12. The bit of claim 11, wherein the finger of hardfacing extends generally upward from the leading edge.

13. The bit of claim 11, wherein the finger of hardfacing extends along an outer portion of the outer surface of the bit leg.

14. The bit of claim 11, further comprising an inner strip of hardfacing extending along a portion of the inner surface of the bit leg.

15. The bit of claim 11, wherein:

the head section further comprises a head section body and the depending bit leg extends from the head section body; and the finger of hardfacing extends circumferentially along a portion of head section body along the bit leg.

16. The earth-boring bit of claim 11, further comprising:

a lower leading edge layer of hardfacing on the leading side of the head section;

an upper leading edge layer of hardfacing on the leading side of the head section; and a gap between the upper and lower leading edge layers.

17. An earth-boring bit comprising:

a bit body comprising a plurality of head sections;

a cutter rotatably mounted to cantilevered bearing shaft depending inwardly from each of the head sections for mounting a cutter;

a leading side machined beveled surface formed at a junction of a leading side of each of the head sections and the outer surface of each head section, the leading side machined beveled surface being an angle relative to a radial plane emanating from an axis of rotation of the bit, the angle being at least 20 degrees;

leading edge layer of hardfacing formed on the leading side machined beveled surface; and a finger of a hardfacing formed on an outer a surface of the head section spaced above a lower end of the head section, the finger of hardfacing extending from the leading edge of hardfacing toward a trailing side of a each head section and having an upper edge that defines a diversion surface that engages and guides the cuttings when the earth-boring bit is rotating.

18. The earth-boring bit of claim 17, further comprising a trailing side machined beveled surface formed at a juncture of the trailing side and the outer surface of the head section, the trailing side machined beveled surface being an angle relative to a radial plane emanating from an axis of rotation of the bit, the angle being at least 20 degrees.

19. The earth-boring bit of claim 17, wherein the bit leg has a shirttail formed along an edge that corresponds with the cutter; and the finger of a hardfacing extends from the leading side machined beveled surface circumferentially around at least part of the bit leg and away from the shirttail.

20. The earth-boring bit of claim 17, wherein the leading edge layer of hardfacing formed on the leading side machined beveled surface defines a lower leading edge layer of hardfacing;

and further comprising:

an upper leading edge layer of hardfacing on a leading surface of each head section; and a gap between the upper and lower leading edge layers.

21. The earth-boring bit of claim 17, wherein the leading edge layer of hardfacing formed on the leading side machined beveled surface defines a lower leading edge layer of hardfacing;

and further comprising:

an upper leading edge layer of hardfacing on a leading surface of each head section, the upper leading edge layer of hardfacing having an upper transverse finger of hardfacing extending circumferentially around at least a portion of the head section above a bit leg.

22. An earth-boring bit comprising:

a bit body comprising a plurality of head sections, each head section having a depending bit leg with a circumferentially extending outer surface, an inner surface, a leading side and a trailing side;

a cutter rotatably mounted on a cantilevered bearing shaft depending inwardly from each of the bit legs; and a trailing side machined beveled surface formed at a junction of the trailing side and the outer surface of the bit leg of each head section, the trailing side machined beveled surface being an angle relative to a radial plane emanating from an axis of rotation of the bit, the angle being at least 20 degrees.

23. The earth-boring bit of claim 22, wherein the angle is between 20 and 60 degrees.

24. The earth-boring bit of claim 22, wherein the angle is between 20 and 50 degrees.

25. The earth-boring bit of claim 22, wherein the angle is at least 30 degrees and no more than 45 degrees.

26. The earth-boring bit of claim 22, further comprising a layer of a hardfacing composition of carbide particles dispersed in a metallic matrix formed on the trailing side machined beveled surface.

* * * * *